US011565930B2

(12) United States Patent
Glucksman et al.

(10) Patent No.: US 11,565,930 B2
(45) Date of Patent: Jan. 31, 2023

(54) SMART PHONE DRINK MAKER

(71) Applicant: Appliance Development Corporation, Danvers, MA (US)

(72) Inventors: Dov Z. Glucksman, Winchester, MA (US); Andrew Joseph Rojee, Norfolk, MA (US); Michael David Miller, Tewksbury, MA (US); Joseph Grossi, Amesbury, MA (US)

( * ) Notice: Subject to any disclaimer, the term of this patent is extended or adjusted under 35 U.S.C. 154(b) by 0 days.

(21) Appl. No.: 17/334,573

(22) Filed: May 28, 2021

(65) Prior Publication Data

US 2021/0380392 A1 Dec. 9, 2021

Related U.S. Application Data

(60) Provisional application No. 63/034,860, filed on Jun. 4, 2020.

(51) Int. Cl.
*B67D 1/08* (2006.01)
*B67D 1/00* (2006.01)

(52) U.S. Cl.
CPC ..... *B67D 1/0888* (2013.01); *B67D 1/0021* (2013.01); *B67D 1/0884* (2013.01)

(58) Field of Classification Search
CPC .. B67D 1/0888; B67D 1/0021; B67D 1/0884; B67D 1/0046; B67D 1/0057; B67D 1/0425; B67D 2001/0098; B67D 2001/0811; B67D 2210/00034
See application file for complete search history.

(56) References Cited

U.S. PATENT DOCUMENTS

2016/0039653 A1* 2/2016 Jangbarwala ..... B67D 1/16 222/1
2019/0291062 A1* 9/2019 Wood ..... A47J 31/4492

* cited by examiner

*Primary Examiner* — Donnell A Long
(74) *Attorney, Agent, or Firm* — Frank Marino

(57) ABSTRACT

A beverage system including a beverage appliance and beverage containers where the functions required for creating beverages may be activated and controlled through a pre-programmed specific App (an application, especially as downloaded by a user to a mobile device), residing external to and wirelessly communicating with the apparatus.

19 Claims, 15 Drawing Sheets

SMART PHONE DRINK MAKER

FIELD OF THE INVENTION

This invention relates to beverage system including a beverage appliance apparatus and a beverage container where the functions and user interface required for creating beverages may be activated and controlled through a pre-programmed App (an algorithm created specifically for the beverage system), residing external to, and wirelessly communicating with the apparatus.

BACKGROUND

The recent COVID-19 pandemic created a new reality in many established parts of the economy. Nowhere has the impact been greater than in the restaurant and bar segment. As a result of this more people were looking to substitute their visit to the bar with preparing mixed drinks at home. At present there are several appliances available to the consumer in the US, and there are most likely many more of these type appliances available in other countries. Many of the beverage appliances in the US market at the present are capsule-based and some use pre-mixed concentrates or other manners to provide the alcohol and mixes.

The appliances presently available to the consumer in the US carry a price tag that ranges from $200 and up. For the most part, these appliances are relatively large and occupy large amount of countertop space, be it in the kitchen, the wet bar, or a man-cave. Amongst the more popular and heavily advertised product is the Drinkworks® Home Bar by Keurig® being offered for sale at a price range of $250 to $299. To create a mixed beverage the user would have to place a beverage container into the appliance, retailing at an average price of $4.00.

While it is understood that there are other types of automatic beverage appliances available in the US market it was determined to use The Drinkworks® Home Bar appliance and beverage containers as the representative prior art, as it is known to be the dominant system in the US market, and the system offers many user benefits which drive the demand for the appliance, some of these user-benefits include:

a. Speed—The machine takes about 1 minute to produce a mixed drink.

b. Variety—The user can create a variety of drinks without having to purchase various liquors, mixes, and flavorings.

c. Quality—User feedback indicates a high level of satisfaction with the quality of the drink.

d. Convenience—User can produce any mixed beverage effortlessly.

e. Simplicity—User need not remember beverage recipes or look them up.

f. Space savings—User need not stock alcohol, mixes, and other additions.

g. Pride of ownership—The appliance is impressive and attractive.

h. Recognizable brand—Drinkworks® Home Bar is marketed under the well-known Keurig® brand.

The business model being followed is based on the long-term revenue being generated by the sale of consumables (the beverage containers in the case of the Drinkworks® Home Bar). It should be based on offering the beverage appliance at an attractive price and relying on the profit to be generated from beverage containers sales. Due to the high manufacturing cost of the appliance it is offered to the consumer at a price point of $250, which understandably creates a barrier to broaden the customer base needed to increase the sales of the consumables, namely the beverage containers.

Size and product footprint are other factors that might create a barrier to broaden the customer base of the beverage appliance. The expected potential customer typically lives in an urban environment with limited space that would not support another large appliance, especially where the product might be used daily, and therefore would not be put away after each use.

Lastly, while the beverage appliance offers the user all the benefits listed above, it has some inherent drawbacks such as a long cooldown time, the need to purchase CO2 containers, and the need for routine draining and cleaning.

Therefore, a strong case can be made for an appliance offering all, or most of, the user benefits of the existing Drinkworks® Home Bar at a lower price point. This is especially true if such product had a small footprint, requiring minimum maintenance, and needed no cooldown time. These criteria could be met if the appliance includes just the bare minimum of the components required to extract the content from the beverage container and excludes carbonation and refrigeration. Further savings could be made if the control functions are stored in a mobile app rather than a PCB as is the case with the current product. While saving a great deal of cost, it also stands to reason that a beverage appliance that is controlled through a smart phone app would appeal to a broad segment of the market, particularly tech savvy individuals.

The foregoing examples of the related art and limitations related therewith are intended to be illustrative and not exclusive. The limitations of the related art will become apparent to those skilled in the art upon a reading of the specification and a study of the drawings.

SUMMARY OF THE INVENTION

One aspect of the present invention is to provide a low-cost, small footprint, easy to use beverage appliance which communicates with an App that may be downloaded to the user's smart phone or tablet. The beverage appliance is designed to be used in conjunction with beverage containers such as the Drinkworks® beverage containers.

The invention may be embodied in or practiced using a beverage system comprising: a beverage container having a beverage material sealed therein; and a beverage appliance configured to receive the beverage container and produce a beverage from the beverage material, the beverage appliance comprising a precursor supply and a dispensing assembly, the dispensing assembly configured to combine the beverage material with the precursor supply, wherein the beverage container further comprises indicia specific to the content of the beverage material sealed therein, and the beverage system further comprising a specifically programmed downloadable application, whereupon scanning the indicia the pre-programmed application is prompted to interact with the user and may also interact with the beverage appliance to create and dispense into a user container a beverage specific to the indicia of said beverage container.

BRIEF DESCRIPTION OF THE DRAWINGS

The foregoing summary, as well as the following detailed description of an exemplary embodiment, will be better understood when read in conjunction with the appended drawings.

DETAILED DESCRIPTION OF EXEMPLARY EMBODIMENTS

Figure 1A:
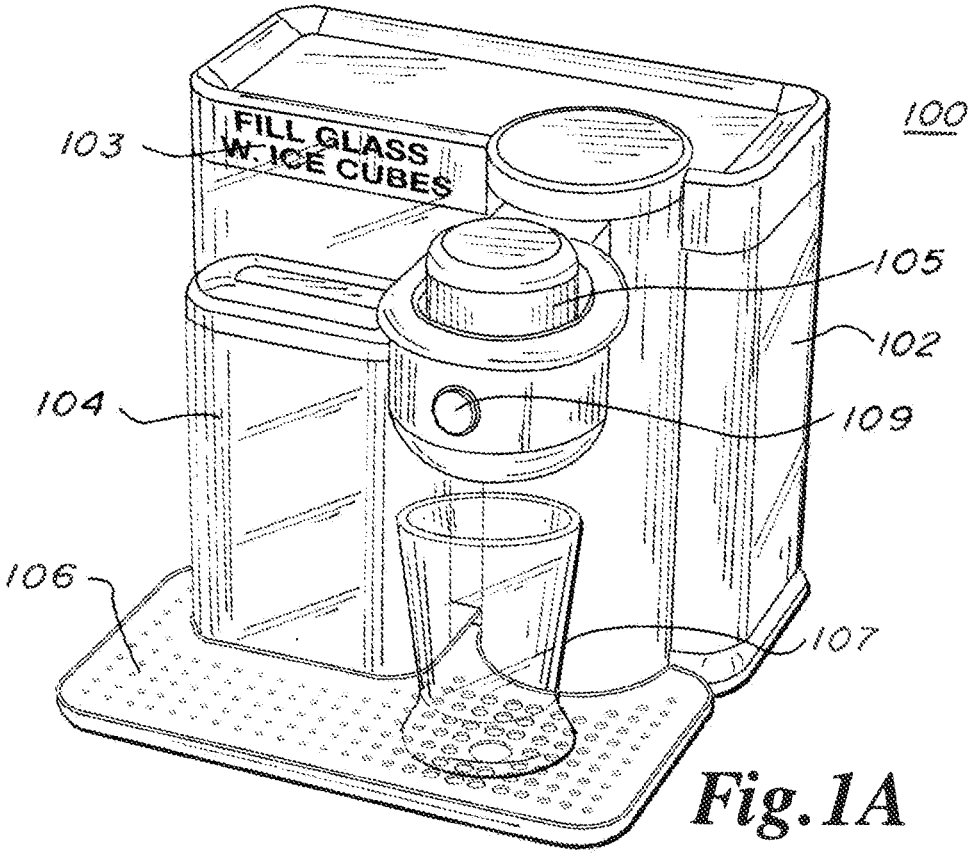
FIG. 1A is an isometric of a beverage appliance according to the prior art.
Figure 1B:
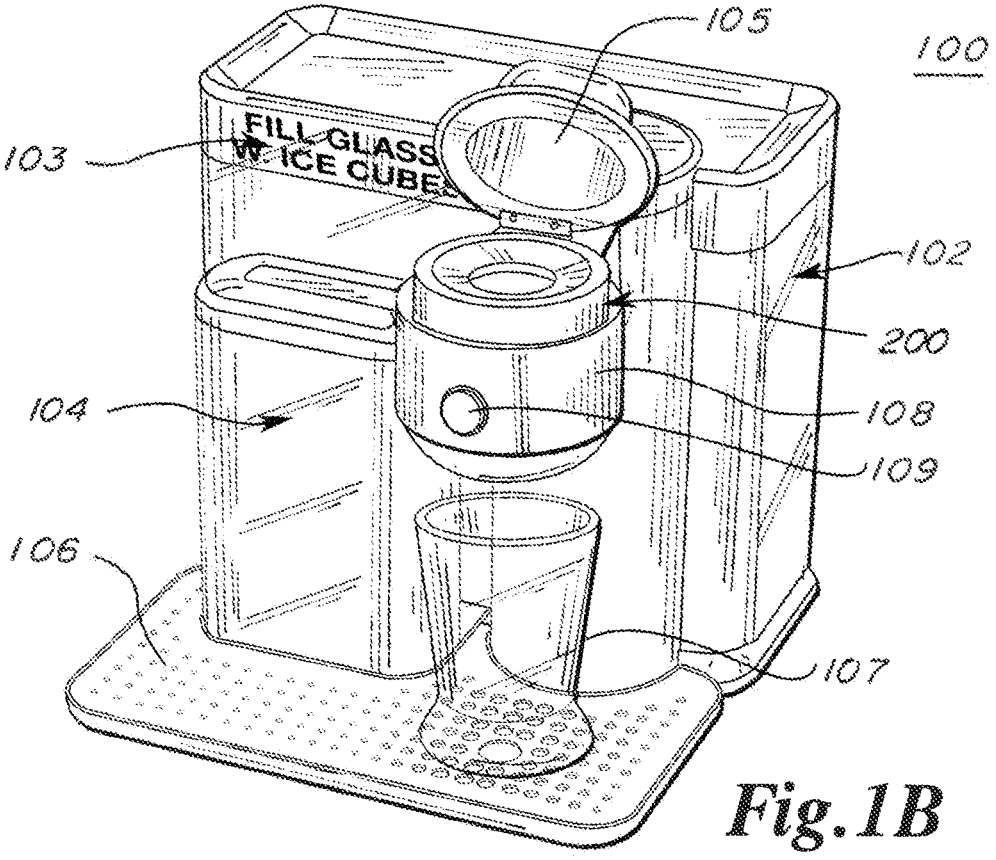
FIG. 1B is an isometric of a beverage appliance according to the prior art with the beverage compartment lid shown in an open position and the beverage container partially visible.

FIGS. 1A and 1B illustrate a beverage appliance 100 according to the prior art, it includes a housing 102 that encloses all the components and the controls required for the operation of the machine, a reservoir 104 that holds a liquid (e.g., water) used to form a beverage, and a drip tray 106 that supports a user container 107 for receiving a dispensed beverage. The reservoir 104 can be removable from the housing 102, such that a user can fill the reservoir 104 with a beverage precursor liquid, such as water, that is used to form a beverage dispensed at a dispensing station 108 into a user container 107. The reservoir 104 can include a movable lid to facilitate a user in filling the reservoir 104 with the precursor liquid. The dispensing station includes a hingeable lid 105 for placement and removal of a beverage container 200.

The various components enclosed within the housing 102 include for example: a hi pressure pump to move precursor liquid from the reservoir 104 to a carbonation system, where the precursor liquid can be carbonated, via a gas, supplied by a pressurized canister or bottle 101, such as a carbon dioxide canister or bottle, located within the housing 102. The precursor liquid is chilled by a cooling system. The precursor liquid is moved to the dispensing station 108 and dispensed into the user container 107. To generate a desired beverage, the carbonated liquid can be mixed with a beverage material contained in a beverage container 200 shown in FIG. 1B by introducing gas or fluid into the beverage container under pressure.

Control of the beverage appliance 100 and its components are performed by control circuitry which is enclosed entirely within the housing 102, which includes a programmed general purpose computer and/or other data processing devices along with suitable software or other operating instructions, one or more memories (including non-transient storage media that can store software and/or other operating instructions), a power supply for the control circuitry and/or other system components, temperature and liquid level sensors, pressure sensors, RFID interrogation devices or other machine readable indicia readers (such as those used to read and recognize alphanumeric text, barcodes, security inks, etc.), input/output interfaces (e.g., such as a user interface to display information to a user and/or receive input from a user), communication buses or other links, a display 103 located on the top front portion of the housing for ease or reading by the user, switches, relays, triacs, motors, mechanical linkages and/or actuators, and/or other components necessary to perform desired input/output or other functions of the beverage machine 100.

Figure 2:
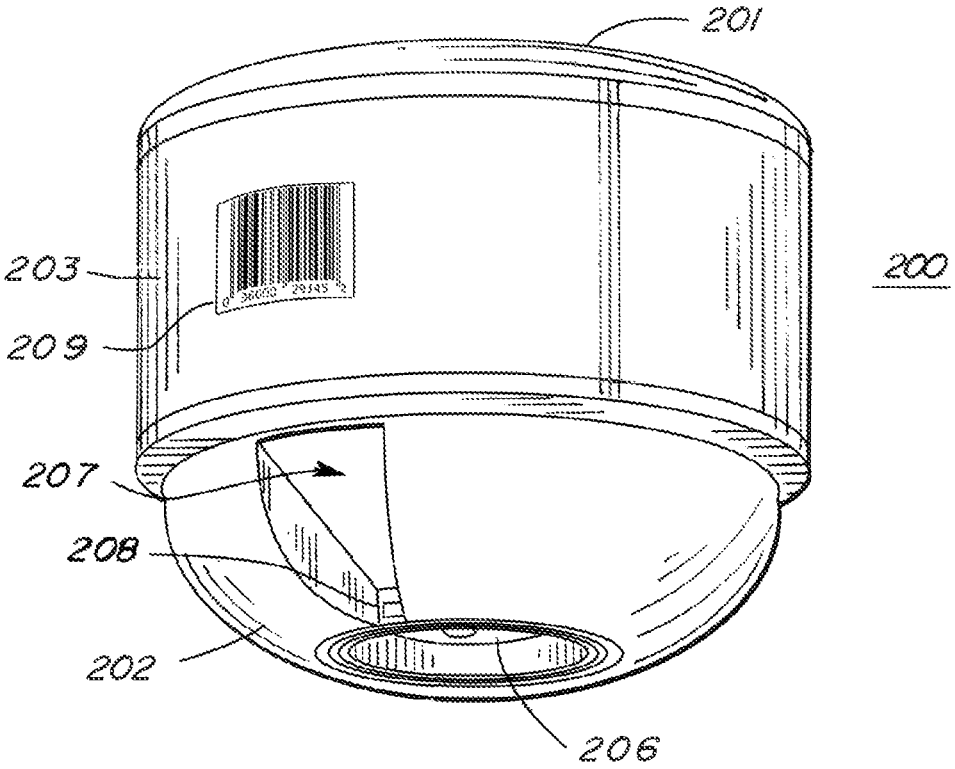
FIG. 2 is an isometric view of a beverage container.

The beverage appliance 100 according to the prior art is designed to receive a beverage container 200, an isometric view of the exterior of which is shown in FIG. 2. The beverage container 200 is configured to hold a target volume of a beverage material 210. The beverage container 200 is shown in FIG. 2 having a body 203 defining a substantially cylindrical shape including a top portion 201 and a bottom portion 202 for holding a volume of the beverage material 210. The bottom portion 202 includes a recess 207 designed to engage a mating part in the dispensing station 108, also shown is an aperture 208 within the recess 207 which aligns with the precursor liquid delivery tube. also shown is a recess 206 at the center of the bottom portions in which precursor and beverage material mix ahead of being delivered into the user container 107. Beverage container 200 also includes indicia 209 readable by the appliance internal controller.

It has been stated above that a strong case can be made for an appliance offering all, or most of, the user benefits of the existing Drinkworks® Home Bar at a low manufacturing cost achieved by designing a system where the beverage appliance includes just the bare minimum of the components required to extract the content from the beverage container, excluding carbonation and refrigeration, eliminating the on-board user interface and the controls associated with it and the electronics required for controlling the rest of the functions of the appliance. All of which being accomplished through a dedicated downloadable app that may be accessed by the user and may communicate wirelessly with the appliance. In addition to the cost savings achievable, such an appliance would have a small footprint, require minimum maintenance, and no need for any cooldown time. It also stands to reason that a beverage appliance that is controlled through a smart phone app would appeal to a broad segment of the market, particularly tech-savvy individuals.

Four different embodiments of such a beverage system and beverage appliance according to the invention are described below in specific detail.

Figure 3A:
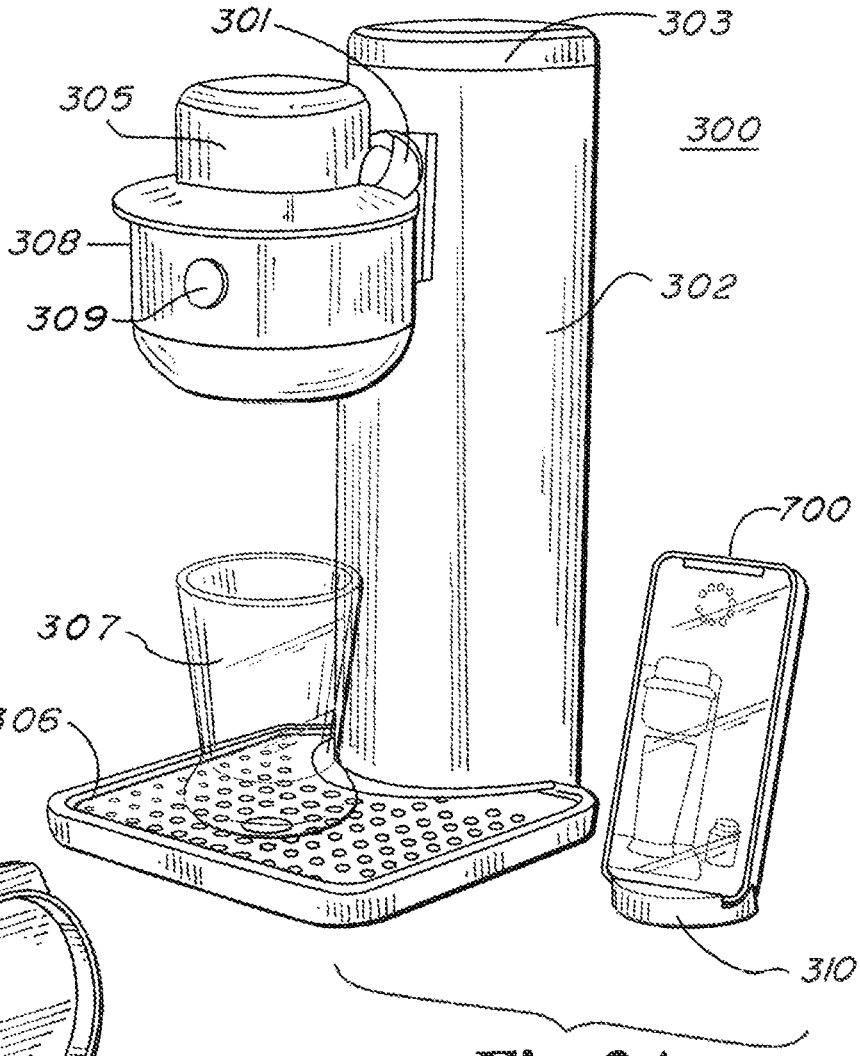
FIG. 3A is a left isometric view of a first embodiment of an apparatus according to the invention.
Figure 3B:
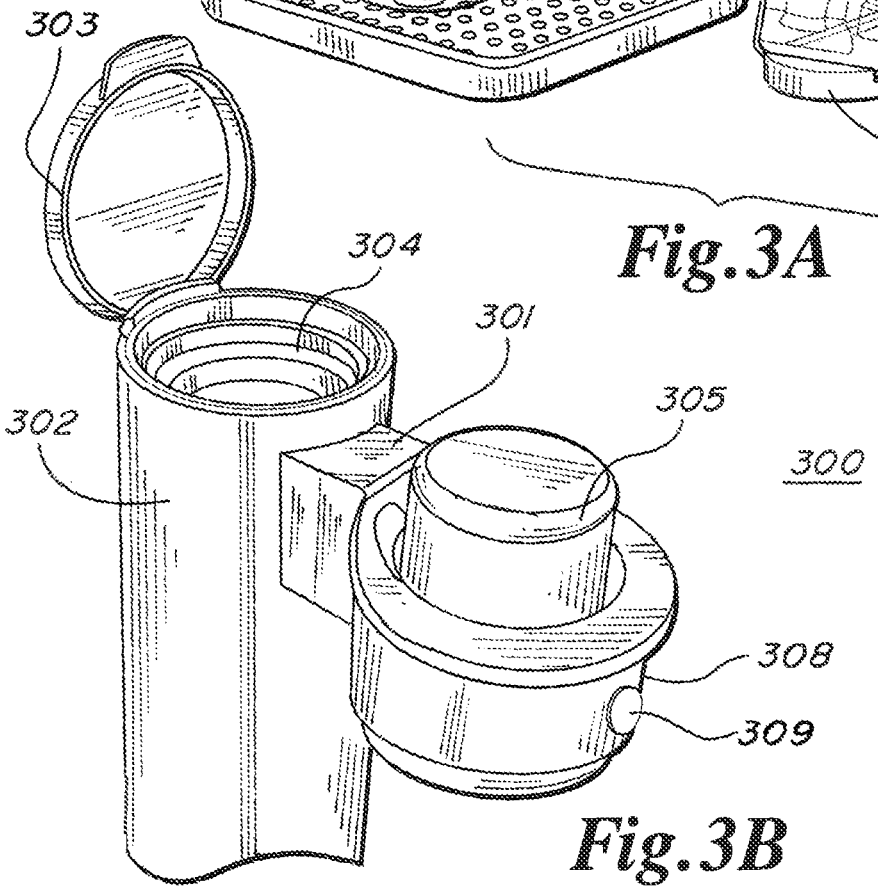
FIG. 3B is a partial right isometric view of the apparatus of FIG. 3A with its precursor supply lid opened.
Figures 3C, 4A:
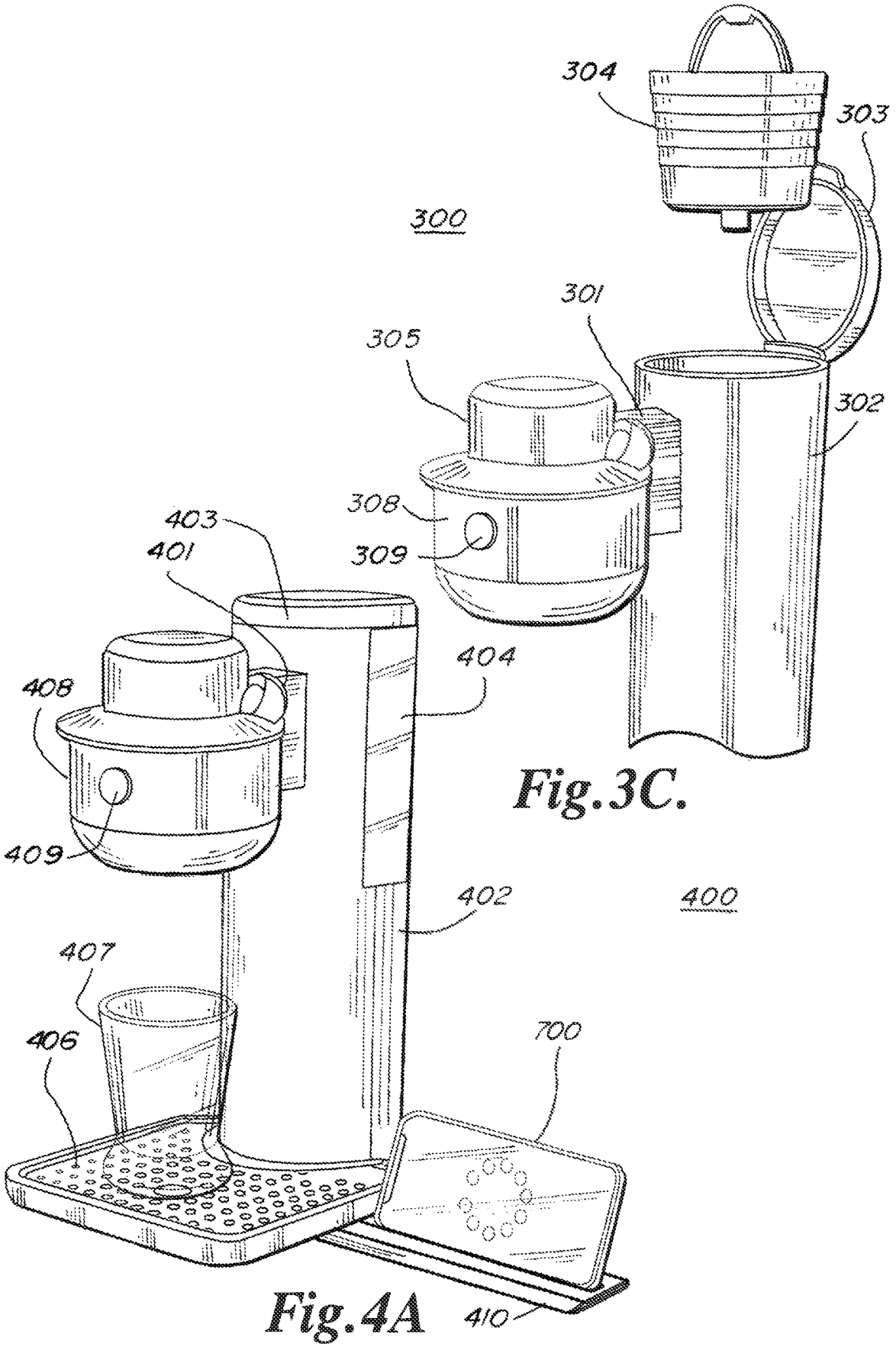
FIG. 3C is a partial left isometric view of the apparatus of FIG. 3A with its precursor container lifted away.
FIG. 4A is a left isometric view of a second embodiment of an apparatus according to the invention.

FIGS. 3A, 3*b* and 3C illustrate a first embodiment 300 of beverage appliance according to the invention, it includes a vertical cylindrical housing 302 that supports a dispensing station 308, via a hollow bridge portion 301 serving as a conduit for air and precursor tubes required for the extraction of the beverage material 210 and for providing the precursor liquid for mixing with the beverage material prior to delivery into the user container 307. The housing 302 is fixed to a wide base 306, also serving as a drip tray and for placing a user container 307 to be filled with a beverage. The housing 302 encloses a graduated precursor container 304 that allowing the user to gauge the amount of precursor liquid (being carbonated, still, plain, or flavored) to be filled in correspondence with the beverage material chosen by the user. Also enclosed in the housing 302 is a pump, (not shown) for moving the precursor liquid from the precursor container to the dispensing station 308 and dispensed into the user container 307, and an air pump (not shown) for pressurizing the beverage container 200 for dispensing the beverage material 210, mixing it with the precursor liquid and delivering it by gravity into the user container 307.

Figure 4B:
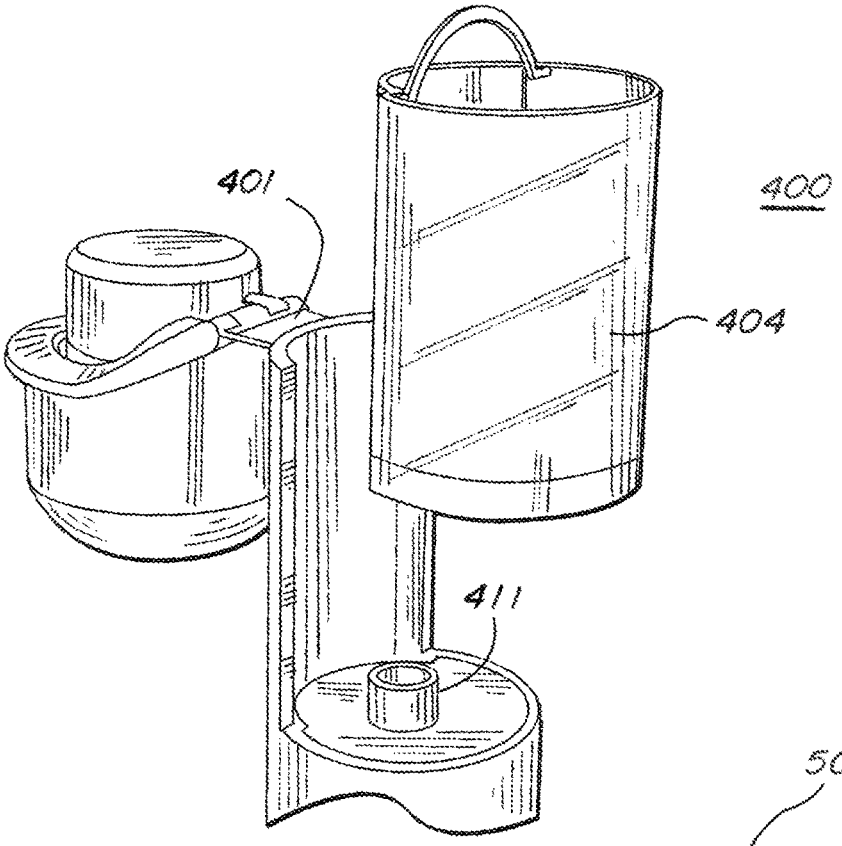
FIG. 4B is a partial right isometric view of the apparatus of FIG. 4A with its lid removed and its precursor container lifted away.

FIG. 3A also shows a smart phone 700 with a screen simulating an image of an app which may provide the user with instructions for creating the beverage according to the content of the specific beverage container placed in the dispensing station. More details of the components of the first embodiment are being provided in FIG. 8, while further information regarding the operation of the first embodiment is provided in the flow chart shown in FIG. 11;

FIGS. 4A and 4B illustrate a second embodiment 400, of beverage appliance according to the invention, it includes a vertical cylindrical housing 402 that supports a dispensing station 408, via a hollow bridge portion 401 serving as a conduit for air and precursor tubes required for the extraction of the beverage material 210 and for providing the precursor liquid for mixing with the beverage material prior to delivery into the user container 407 and for electrical leads connecting a scanner to a control board. The housing 402 is fixed to a wide base 406, also serving as a drip tray and for placing a user container 407 to be filled with a beverage. The housing 402 supports a precursor container 404 to be filled by the user with precursor liquid (being carbonated, still, plain, or flavored) in correspondence with the beverage material chosen by the user. Precursor container 404 is provided with a spring valve for dispensing precursor liquid which remains closed until the precursor container is seated in place, and engaging connector 411 designed to open the spring valve in a manner known in the art. Also enclosed in the housing 402 is a small circuit board (not shown) for controlling the air and liquid pumps, and for transmitting wirelessly the information scanned from the indicis 209 on the beverage cartridge 200 and lastly, housing 402 also encloses a liquid pump, (not shown) for moving the precursor liquid from the precursor container to the dispensing station 308 and dispensed into the user container 407, and an air pump (not shown) for pressurizing the beverage container 200 for dispensing the beverage material 210, mixing it with the precursor liquid and delivering it by gravity into the user container 407.

FIG. 4A also shows a smart phone 700 with a screen simulating an image of an app which may provide the user with instructions for creating the beverage according to the content of beverage container placed in the dispensing station and for controlling the air and precursor and air pumps in accordance with the indices 209 on the beverage cartridge 200.

Figure 5A:
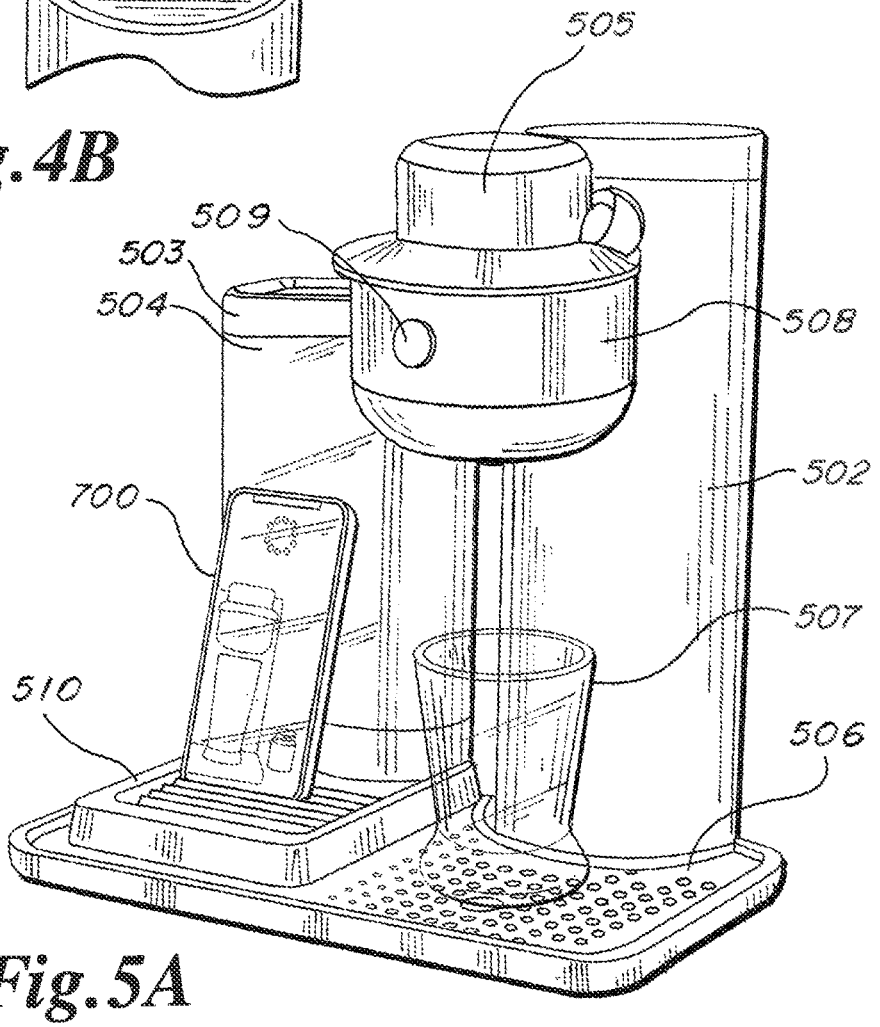
FIG. 5A is a left isometric view of a third embodiment of an apparatus according to the invention.
Figure 5B:
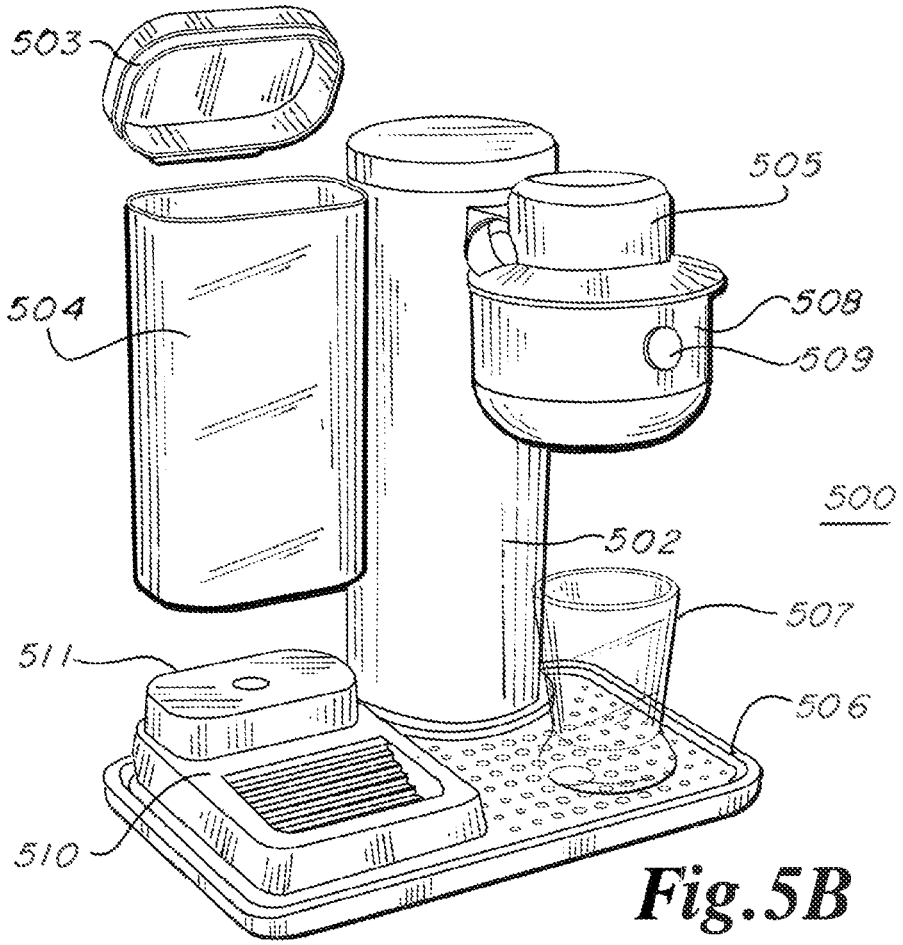
FIG. 5B is a right isometric view of the apparatus of FIG. 5A with its lid and precursor container lifted away.
Figure 9:
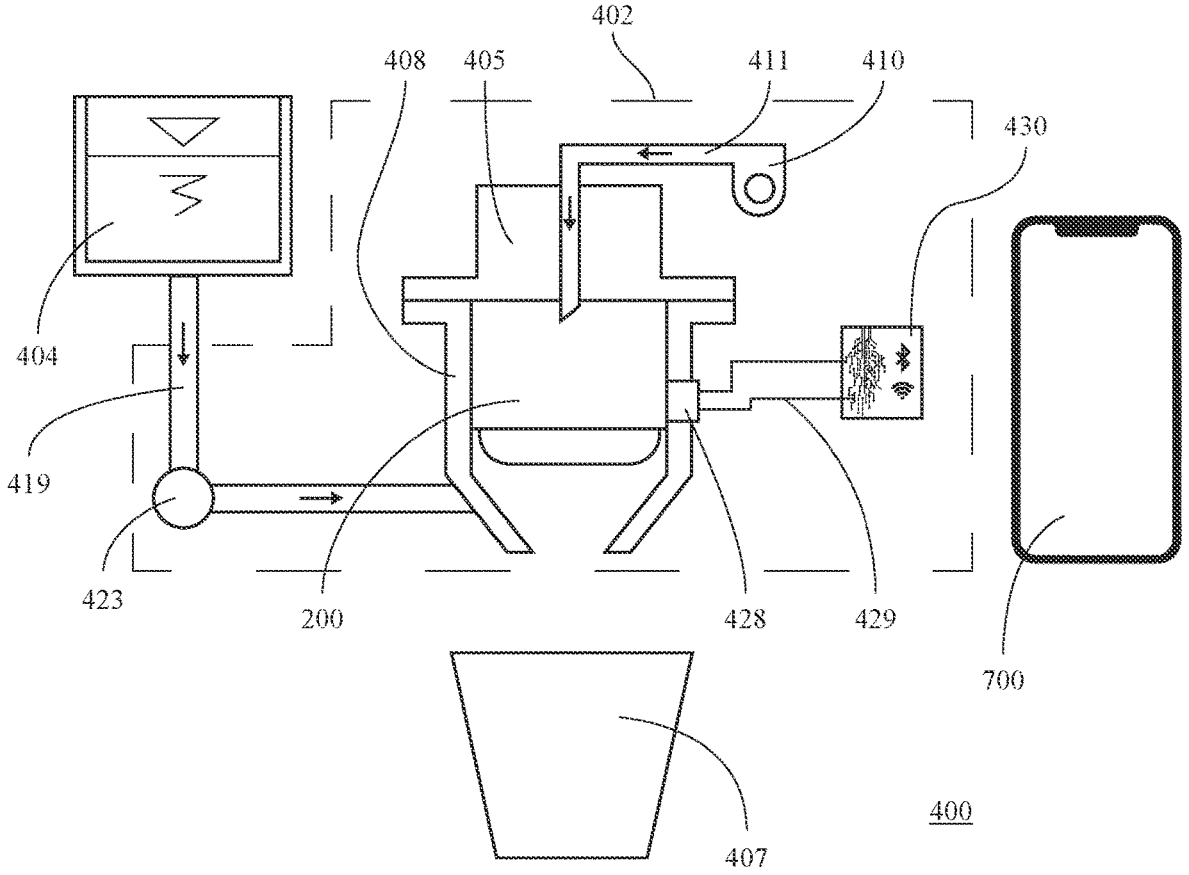
FIG. 9 is a schematic illustration of the beverage appliance according to the second and third embodiments.
Figure 12:
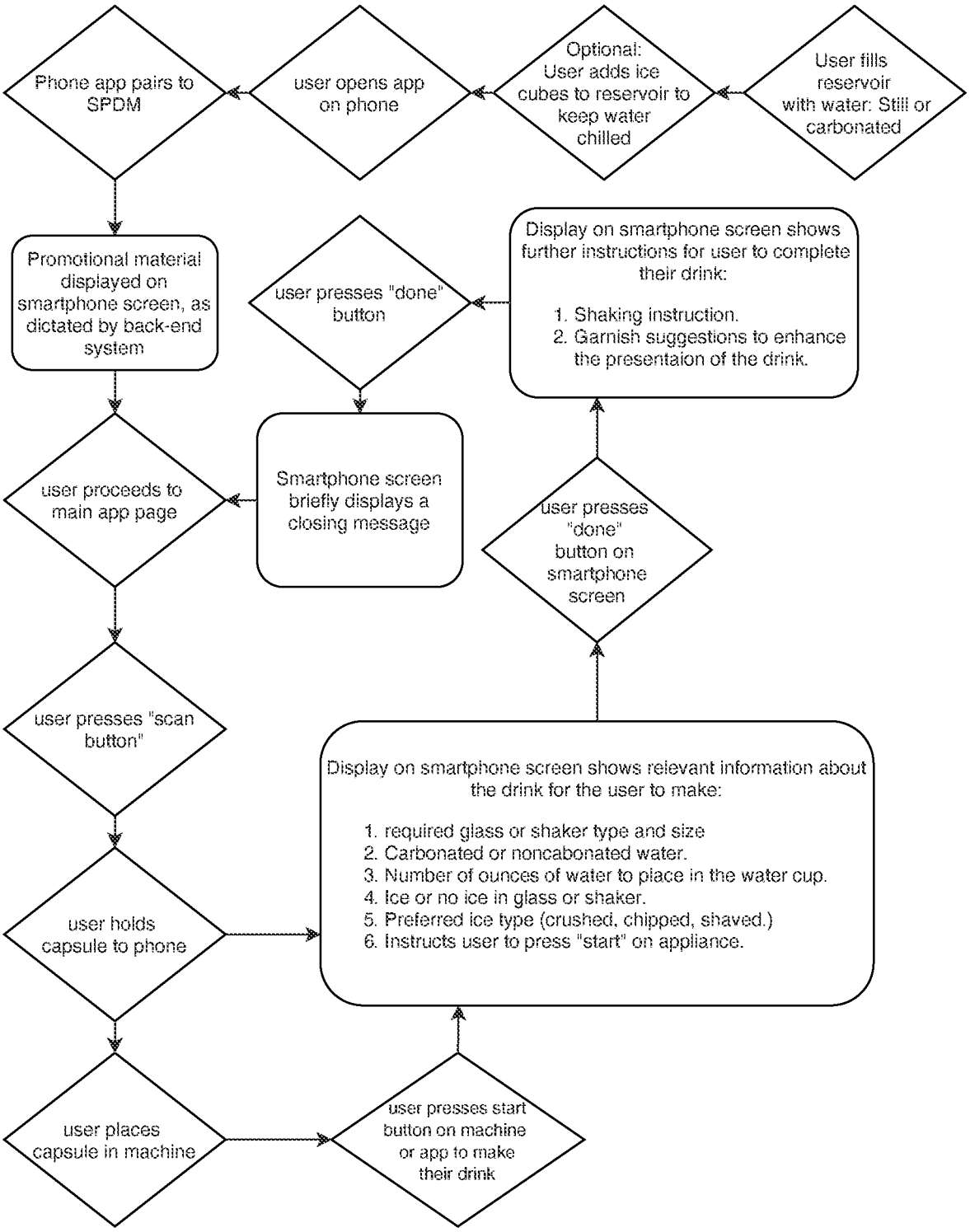
FIG. 12 is a flow chart of the process required to produce a beverage according to the second embodiment according to the invention.

More details of the components of the first embodiment are being provided in FIG. 9, while further information regarding the operation of the first embodiment is provided in the flow chart shown in FIG. 12;

FIGS. 5A and 5B illustrate a third embodiment 500, of beverage appliance according to the invention, it includes a vertical cylindrical housing 502 that supports a dispensing station 508, via a hollow bridge portion 501 serving as a conduit for air tubes and precursor tubes required for the extraction of the beverage material 210 and for providing the precursor liquid for mixing with the beverage material prior to delivery into the user container 507 and for electrical leads connecting a scanner to a control board. The housing 502 is fixed to a wide base 506, also serving as a drip tray and for placing a user container 507 to be filled with a beverage. The base 506 also supports structure 510 for supporting a precursor container 504 to be filled by the user with precursor liquid (being carbonated, still, plain, or flavored) in correspondence with the beverage material chosen by the user. Precursor container is provided with a lid 503 and with a spring valve which remails closed until it is being seated in place, and engaging connector 511 designed to open the spring valve in a manner known in the art. Housing 502 encloses a small circuit board (not shown) for controlling the air and liquid pumps, and for transmitting wirelessly the information scanned from the indicis 209 on the beverage cartridge 200 and lastly, housing 502 also encloses a pump, (not shown) for moving the precursor liquid from the precursor container 504 to the dispensing station 308 and dispensed into the user container 507, and an air pump (not shown) for pressurizing the beverage container 200 for dispensing the beverage material 210, mixing it with the precursor liquid and delivering it by gravity into the user container 507.

FIG. 5A also shows a smart phone 700 with a screen simulating an image of an app which may provide the user with instructions for creating the beverage according to the content of beverage container placed in the dispensing station and for controlling the air pump and precursor pump in accordance with the indices 209 on the beverage cartridge 200.

Figure 6A:
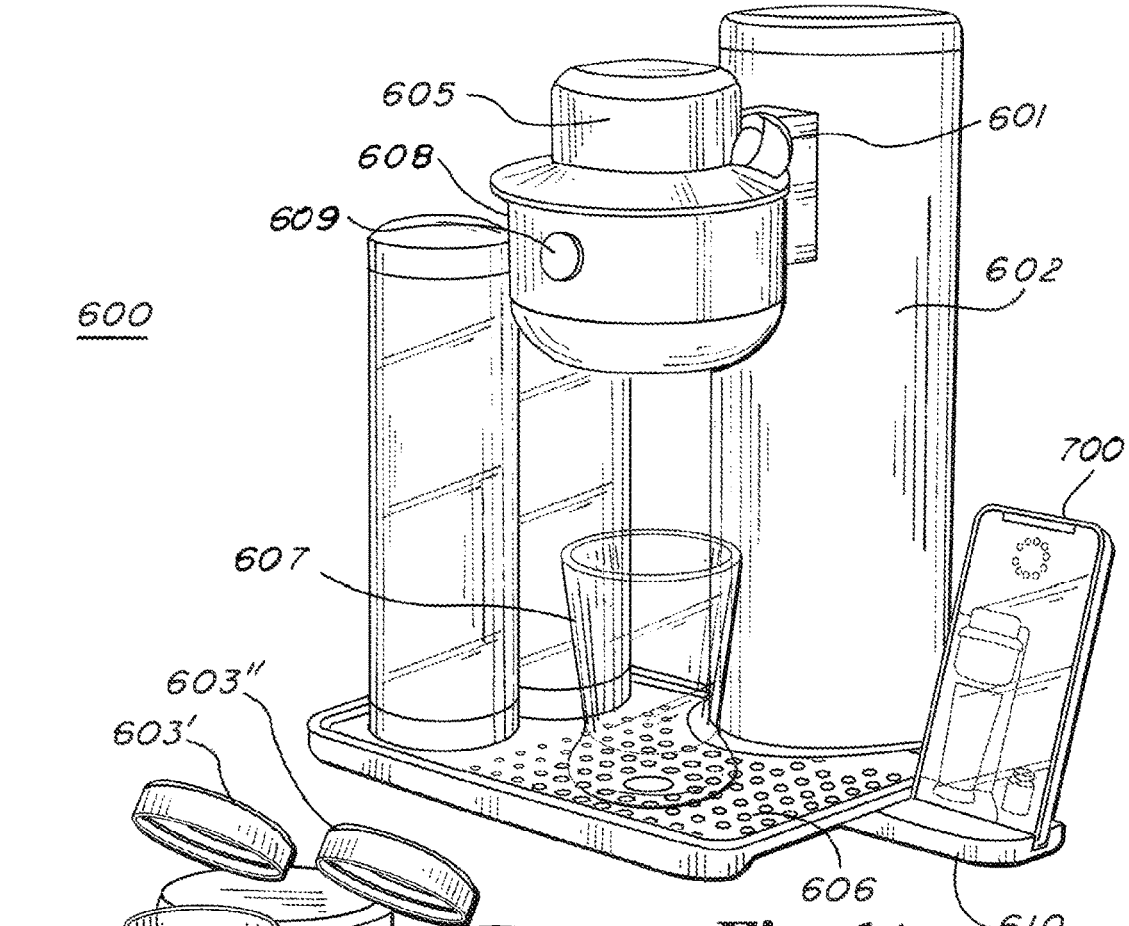
FIG. 6A is a left isometric view of a fourth embodiment of an apparatus according to the invention.
Figure 6B:
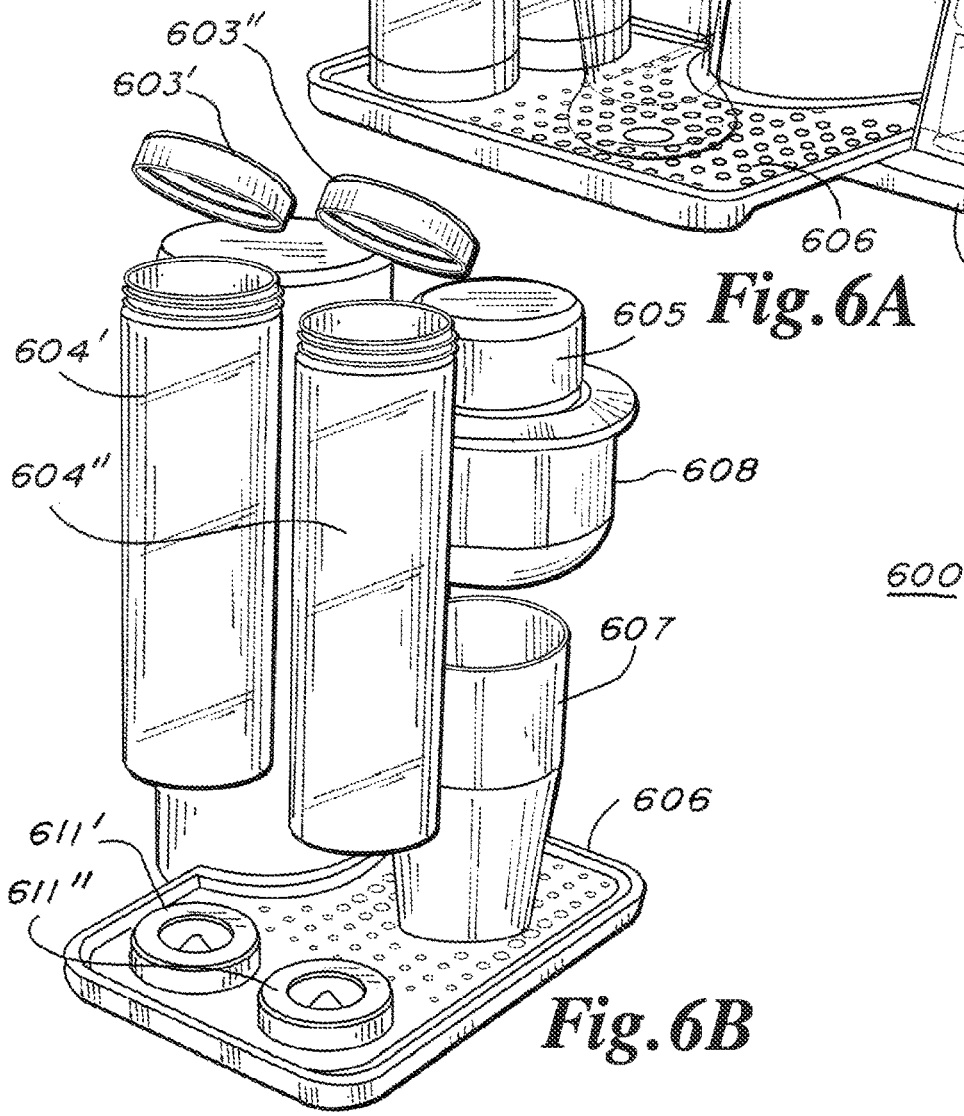
FIG. 6B is a left isometric view of the apparatus of FIG. 6A with its lids and precursor containers lifted away.
Figure 13:
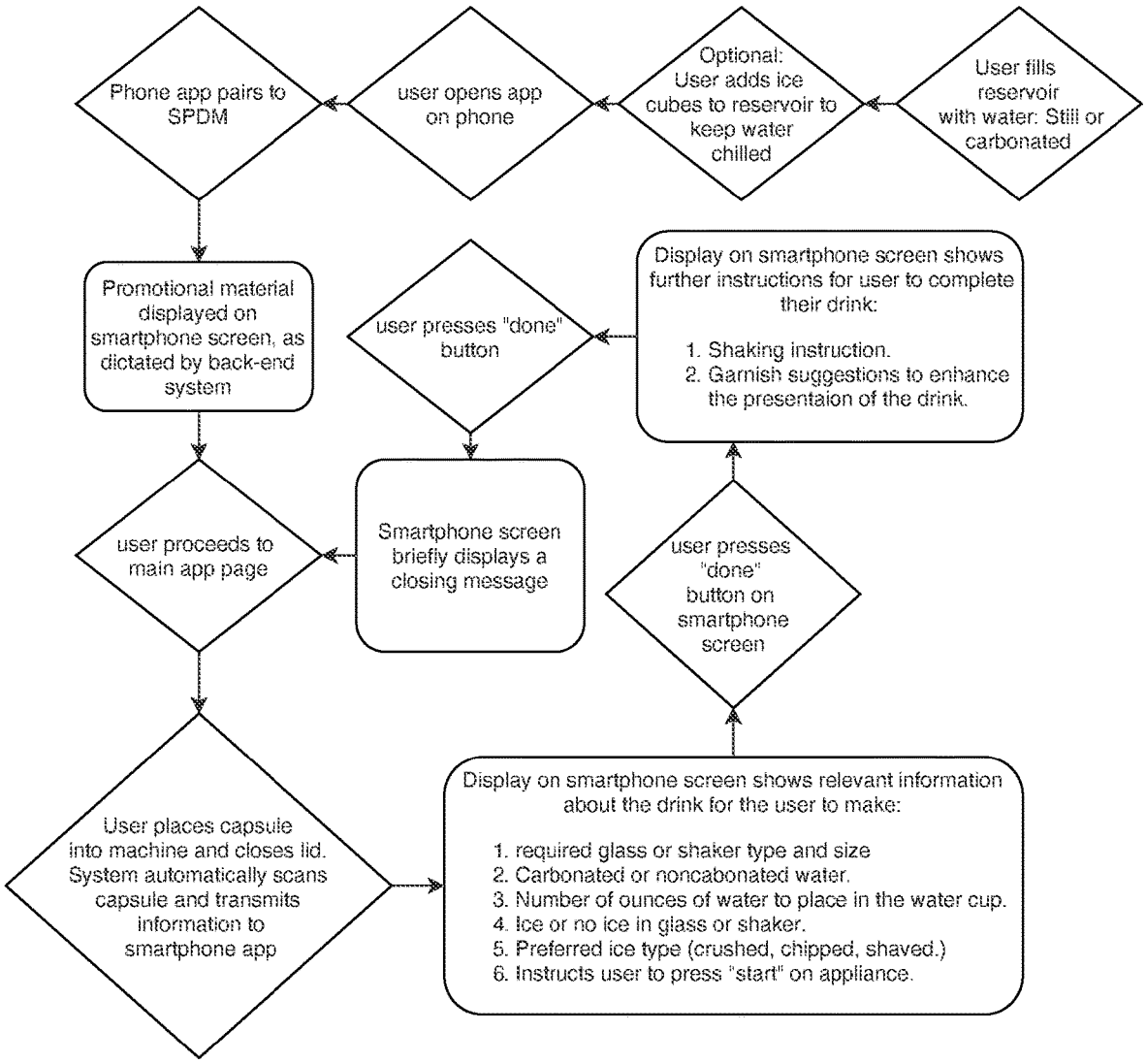
FIG. 13 is a flow chart of the process required to produce a beverage according to the third embodiment according to the invention.

More details of the components of the third embodiment are being provided in FIG. 9, while further information regarding the operation of the first embodiment is provided in the flow chart shown in FIG. 13;

FIGS. 6A and 6B illustrate a fourth embodiment 600, of beverage appliance according to the invention, it includes a vertical cylindrical housing 602 that supports a dispensing station 608, via a hollow bridge portion 601 serving as a conduit for air tube and liquid tubes required for the extraction of the beverage material 210 for providing the precursor liquid for mixing with the beverage material prior to delivery into the user container 607 and for electrical leads connecting a scanner to a control board. The housing 602 is fixed to a wide base 606, also serving as a drip tray and for placing a user container 607 to be filled with a beverage. The base 606 also supports liquid inlet mounds 611' and 611" for supporting precursor containers 604' and 604" to be filled by the user with alternate precursor liquids (such as one filled with still the other with carbonated water, or one being filled with chilled precursor the other with room-temp water) in correspondence with the beverage materials chosen by the user. Precursor containers are provided with lids 603' and 603" intended to be tightly sealed (to help prevent CO2 from "escaping" from carbonated water). Each precursor container includes a spring valve for dispensing precursor liquid, which remails closed until it is seated in place and engaging connectors 611' and 611" designed to open the spring valve in a manner known in the art. Housing 602 encloses a small circuit board (not shown) for controlling the air and liquid pumps, and for transmitting wirelessly the information scanned from the indicis 209 on the beverage cartridge 200 and lastly, housing 602 also encloses a liquid pump, (not shown) for moving the precursor liquid from the precursor container 604 to the dispensing station 608 and dispensed into the user container 607, and an air pump (not shown) for pressurizing the beverage container 200 for dispensing the beverage material 210, mixing it with the precursor liquid and delivering it by gravity into the user container 607.

FIG. 6A also shows a smart phone 700 with a screen simulating an image of an app which may provide the user with instructions for creating the beverage according to the content of beverage container placed in the dispensing station and for controlling the air pump and precursor pump in accordance with the indices 209 on the beverage cartridge 200.

Figure 7:
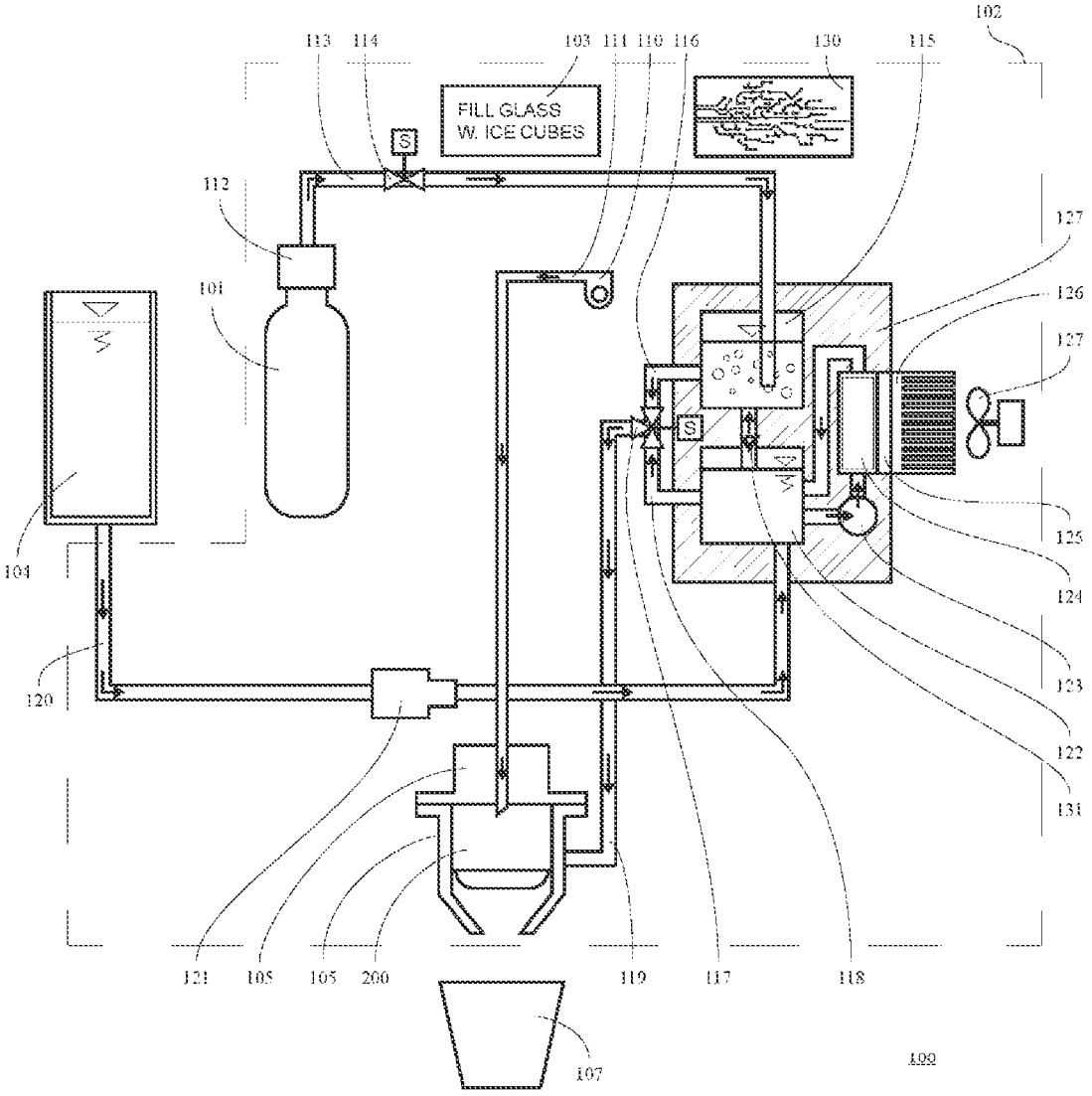
Fig. 7 (Prior Art)
FIG. 7 is a schematic illustration of the beverage appliance according to the prior art.
Figure 10:
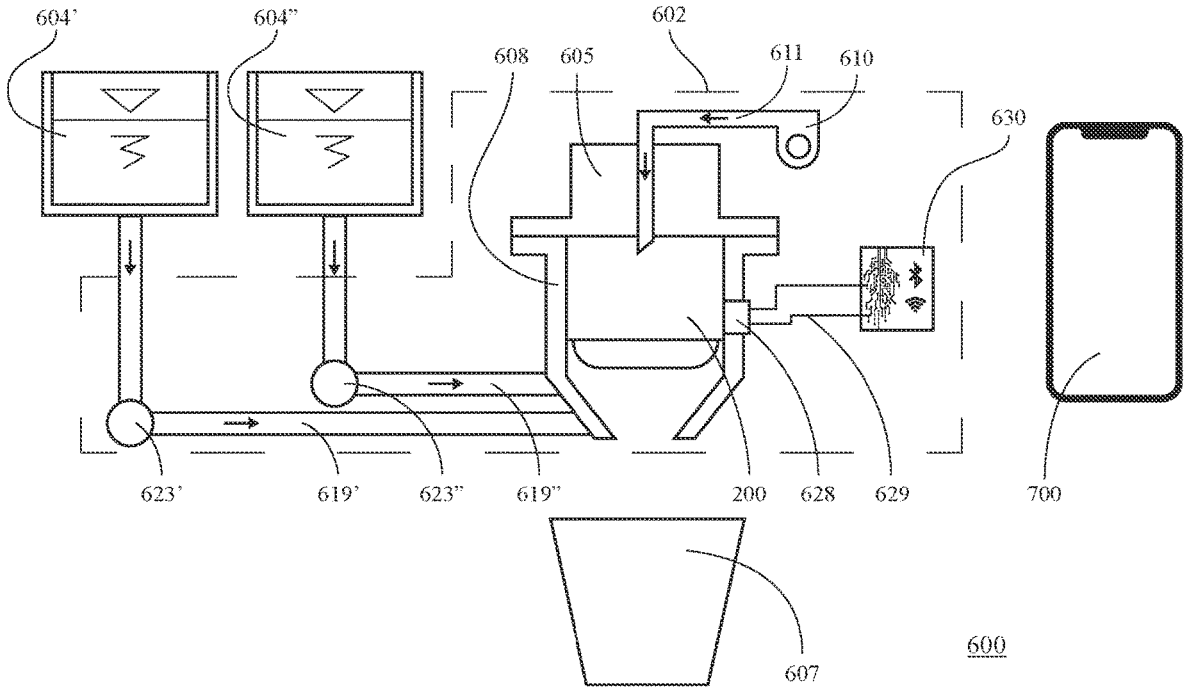
FIG. 10 is a schematic illustration of the beverage appliance according to the fourth embodiment.
Figure 14:
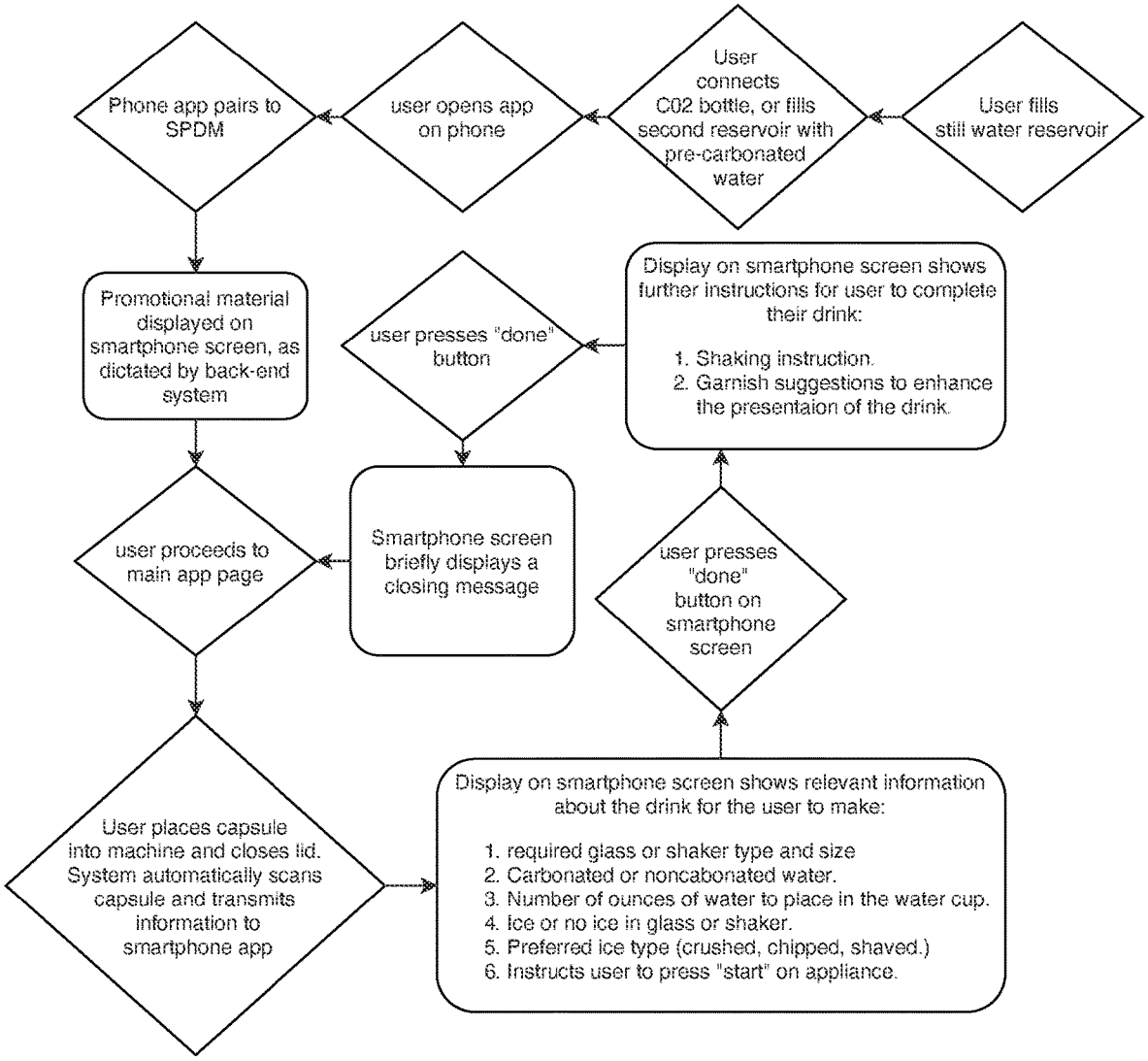
FIG. 14 is a flow chart of the process required to produce a beverage according to the fourth embodiment according to the invention.

More details of the components of the fourth embodiment are being provided in FIG. 10, while further information regarding the operation of the first embodiment is provided in the flow chart shown in FIG. 14;

Prior art beverage appliance is represented in FIG. 7 in a schematic format, where the housing 102 contains a precursor chilling and carbonating module consisting of two containers, one for still liquid 122, and one for carbonated liquid 115 interconnected via a check valve 131. Also included is a Thermo Electric Cooling module 125 connected on its cold side to a liquid chiller 124 and on its warm side to a heat sink 126, cooled by a fan 127. Liquid is continuously circulated between the still liquid container and the liquid chiller to maintain it at a temperature suited to achieve best carbonation results. Both the still liquid container and the carbonated liquid container have delivery lines 116 and 118 connected via a three-way solenoid valve 117 to line 119 for delivery of the precursor liquid to mix with the beverage liquid prior to being delivered into the user container. Carbonation is achieved through a source of CO2, for example a container 101 containing liquid CO2 where the gas is released through a pressure reduction valve 112 and piped through line 113 when solenoid valve 114 is commanded to open. The gas flows into container 115 where it mixes with liquid. It should be pointed out that both containers are maintained at an elevated pressure required for the carbonation process. After precursor liquid is dispensed from the precursor chilling and carbonation module for creating a beverage that amount of liquid must be replenished, by being delivered from the liquid container 104 via a high-pressure pump 121. The entire precursor chilling and carbonation unit is maintained in a thermally insulated enclosure 127. The beverage appliance further includes an air pump 110 and an airline 111 designed to pressurize the beverage container 200 to dispense the beverage material 210 through the bottom 206 of the beverage container for mixing with the precursor liquid as being dispensed into the user container.

The beverage appliance 100 according to the prior art must contain a very elaborate control circuit 130 to manage the operation of the appliance including the user interface 103, used to direct and instruct the user what type of user container to use, whether to place ice in the user container, what garnishes to add to the drink, and others.

It would be apparent to a person skilled in the art that the components and the controls required for the operation of the beverage appliance according to the prior are expensive and require a large enclosure to be contained.

Figure 8:
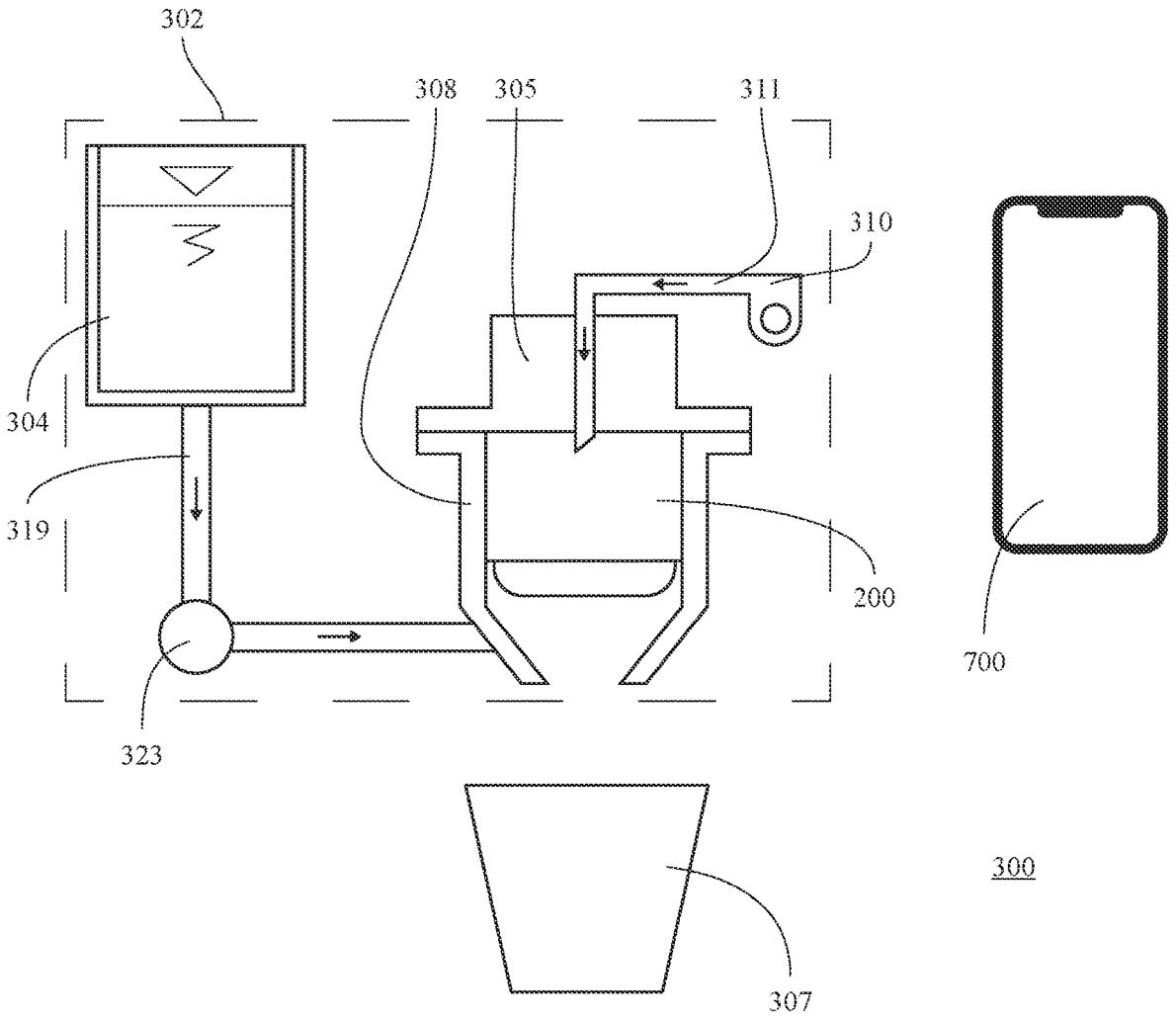
FIG. 8 is a schematic illustration of the beverage appliance according to the first embodiment.

The first exemplary embodiment is represented in FIG. 8 in a schematic format, where the housing 302 contains a graduated precursor liquid container 304 which is connected via a liquid line 319 and a liquid pump 323 to the beverage enclosure 308, for the precursor liquid to mix with the beverage material prior to being delivered to the user container 307. Also includes an air pump 310 and an airline 311 designed to pressurize the beverage container 200 to dispense the beverage material 210 through the bottom 206 of the beverage container for mixing with the precursor liquid prior to being dispensed into the user container.

The entire user interface is accomplished through the app on the smart phone 700. The app is programmed to initially prompt the user to take a picture of the indices 209 on the beverage cartridge 200. The picture is then processed by the program to identify the beverage cartridge being use and to initiate the relevant user interface used to direct and instruct the user as to the amount and type of precursor liquid to place in the precursor container 304 what type of user container 307 to use, whether to place ice in the user container, what garnishes to add to the drink, and others and to instructs the user when to press the on off button 309 to start and stop the beverage making process.

Due to its compactness, the minimum power required by the beverage appliance according to the first embodiment of the invention it could be designed as a battery-operated apparatus, and thereby usable while camping, tailgating, or at poolside. Alternately, it could be used at home by being plugged into low-voltage power supply, thereby being classified by the electrical approval authorities as a low voltage appliance, being exempt from the costly and time-consuming safety approval testing.

Some of the advantages of the beverage appliance according to the first embodiment over the prior art include: no need for user to wait for the system to cool down, or to drain and clean the unit, as no precursor liquid remains in the unit at the end of the cycle. There is no need to purchase and exchange CO-2 canisters. The only extra step is to fill the precursor cup before each use.

It would be apparent to a person skilled in the art that the few components required for the operation of the beverage appliance according to the first embodiment of the invention are far less expensive and require a smaller enclosure than the prior art.

The second and the third exemplary embodiments are represented in FIG. 9 in a schematic format, where the housing 402 contains a liquid transfer system consisting of a seat for the liquid container, a liquid line 419 and a liquid pump 423 to for delivery of precursor liquid from a precursor liquid container 404 to the beverage enclosure 408, for the precursor liquid to mix with the beverage material prior to being delivered to the user container 407. Also includes an air pump 410 and an airline 411 designed to pressurize the beverage container 200 to dispense the beverage material 210 through the bottom 206 of the beverage container for mixing with the precursor liquid prior to being dispensed into the user container.

The entire user interface is accomplished through the app on the smart phone 700, used to direct and instruct the user as to the type of precursor liquid to place in the precursor container 404 what type of user container 307 to use, whether to place ice in the user container, what garnishes to add to the drink, and others.

The control circuit 430 in the second and third embodiment consists of a scanner positioned to read the indices 209 of the beverage container 200, to wirelessly transmit that information to the smart devices, such as the smart phone 700 for controlling a timing circuit which is part of the control circuit 430 to turn the air pump and the precursor pump on and off in accordance with the information provided by indices 209.

Some of the advantages of the beverage appliance according to the second and third embodiments over the prior art include: no need for user to wait for the system to cool down, or to drain and clean the unit, as the only liquids remaining in the unit at the end of the cycle are in the precursor container 404, which would be removed, empties and refilled at the start of a new cycle. There is no need to purchase and exchange CO-2 canisters.

It would be apparent to a person experienced in the art that the few components and minimal controls required for the operation of the beverage appliance according to the second and third embodiments of the invention, while being more elaborate than that in the first embodiment are far less expensive and require a smaller enclosure than the prior art.

The fourth exemplary embodiment is represented in FIG. 10 in a schematic format, where the housing 602 contains liquid lines 619' and 619" and two liquid pumps 623' and 623" for delivery of precursor liquid from two precursor liquid containers 604' and 604" to the beverage enclosure 608, for the precursor liquid to mix with the beverage material prior to being delivered to the user container 607. Housing 602 also includes an air pump 610 and an airline 611 designed to pressurize the beverage container 200 to dispense the beverage material 210 through the bottom 206 of the beverage container for mixing with the precursor liquid prior to being dispensed into the user container.

The objective of having two (or more) precursor containers was to facilitate the beverage appliance to create consecutively beverages that require, for example still precursor and carbonated precursor, by the appliance having one liquid container with still precursor and the other with carbonated precursor.

The entire user interface is accomplished through the app on the smart phone 700, used to interact with the user by prompting answers to the following, for examples: what was the type of precursor liquid that was placed in liquid containers 604' and 604"? Also prompting to user to provide a specific type of user container 607, whether to place ice in the user container, what garnishes to add to the drink, and others.

The control circuit 630 in the fourth embodiment consists of a scanner positioned to read the indices 209 of the beverage container 200, to transmit that information to the smart devices, such as the smart phone 700 for controlling a timing circuit which is part of the control circuit 630 to turn the air pump and precursor pumps on and off in accordance with the information provided by indices 209.

Some of the advantages of the beverage appliance according to the fourth embodiment over the prior art include: no need for user to wait for the system to cool down, or to drain and clean the unit, as the only liquids remaining in the unit at the end of the cycle are in the precursor containers 604' and 604", which would be removed, empties and refilled at the start of a new cycle. There is no need to purchase and exchange CO-2 canisters.

It would be apparent to a person skilled in the art that the few components and minimal controls required for the operation of the beverage appliance according to the fourth embodiments of the invention, while being more elaborate than that in the first embodiment are far less expensive and require a smaller enclosure than the prior art.

Figure 11:
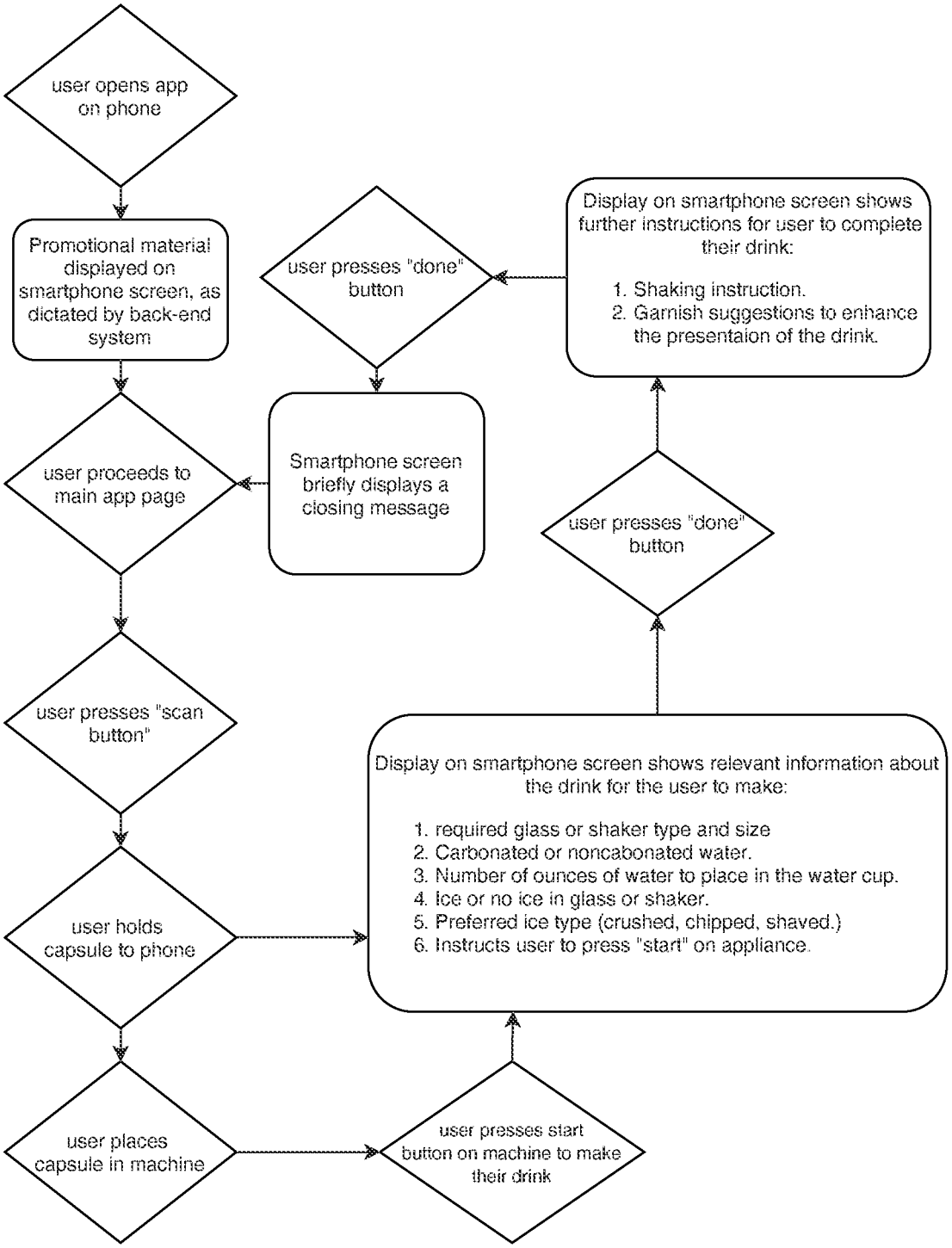
FIG. 11 is a flow chart of the process required to produce a beverage according to the first embodiment according to the invention.

FIG. 11 is a detailed flow chart describing the user interaction with the user interface displayed on the smart phone 700 screen as it relates to the first embodiment of the beverage appliance according to the invention. The flow chart is self-explanatory to persons of average skills in the art.

FIG. 12 is a detailed flow chart describing the user interaction with the user interface displayed on the smart phone 700 screen as it relates to the second embodiment of the beverage appliance according to the invention. The flow chart is self-explanatory to persons of average skills in the art.

FIG. 13 is a detailed flow chart describing the user interaction with the user interface displayed on the smart phone 700 screen as it relates to the third embodiment of the beverage appliance according to the invention. The flow chart is self-explanatory to persons of average skills in the art.

FIG. 14 is a detailed flow chart describing the user interaction with the user interface displayed on the smart phone 700 screen as it relates to the fourth embodiment of the beverage appliance according to the invention. The flow chart is self-explanatory to persons of average skills in the art.

The drawings and specifications outlined above demonstrate that it is possible to use the vast amount of logic present in contemporary smart phones in conjunction with a downloadable application as a replacement for most of the controls in a beverage appliance as per the prior art thereby reducing the cost and the size of the appliance it also clearly apparent that use of the mobile app is not only cost effective but can also enhance the user experience, by:

a. Being fun/engaging, especially to tech-savvy individuals
b. Adding a wow factor to the product
c. Enabling the user to customize beverages.
d. Being an effective reference guide to quickly create a beverage with minimal steps.

Smart Phone app can also provide extensive information about the drink, such as amount of alcohol in drink, calories, snack pairings, etc. In addition, use of smart phone for interaction with the beverage appliance may be password protected to prevent use by underage family members. Through IoT and e-commerce connectivity the App can also alert user to order more beverage containers, special offerings, generate orders and pay for purchase, etc.

It should be understood that while the invention has been shown and described with reference to the specific exemplary embodiments shown, various changes in form and detail may be made without departing from the spirit and scope of the invention, and that the invention should therefore only be limited according to the following claims, including all equivalent interpretation to which they are entitled.

We claim:

1. A beverage system comprising:

a beverage container having beverage material therein and an indicium specific thereto; and a beverage appliance configured to receive the beverage container and a plurality of precursor supplies to enable the containment of a variety of precursor liquids each intended to interact with the beverage material to create a selected one of a variety of beverages, and a dispensing assembly, and a first controller; wherein the beverage appliance includes an indicium reader and a first transmitter/receiver, and is configured to combine the beverage material with liquid from a selected one of the precursor supplies within the beverage container; and a second controller including a second transmitter/receiver adapted for wireless communication with the first transmitter/receiver;

wherein scanning the indicium and transmittal of information specific thereto to the remote controller by the beverage appliance causes the remote controller to prompt wireless interaction between a user and the beverage appliance to cause the user to select a desired beverage, and such selection causes the beverage appliance to extract a selected liquid from a selected one of the precursor supplies, to cause mixing of that selected liquid with the beverages material to create the desired beverage and to cause the dispensing of the desired beverage.

2. The beverage system of claim 1 wherein the second controller enables user interaction to prompt user-selectable additional process instructions specific to user preferences.

3. The beverage system of claim 2 wherein the second controller is a smartphone.

4. The beverage system of claim 3 wherein the smartphone includes a mobile app.

5. The beverage system of claim 4 wherein the first controller and the smartphone both include Bluetooth® wireless capability and the wireless communication therebetween is by Bluetooth®.

6. The beverage system of claim 5 wherein the indicium is one of a readable code displayed on the outside of the beverage container and an RFID chip.

7. The beverage system of claim 6 wherein the plurality of precursor supplies includes carbonated and non-carbonated water reservoirs.

8. The beverage system of claim 7 in combination with a user container removably supportable by the beverage appliance and adapted to receive the dispensed beverage.

9. The combination of claim 8 wherein the first controller further includes a computer adapted to employ the received process instructions to effect control of the dispensing assembly.

10. The beverage system of claim 6 wherein the plurality of precursor supplies includes carbonated and non-carbonated water reservoirs.

11. The beverage system of claim 10 in combination with a user container removably supportable by the beverage appliance and adapted to receive the dispensed beverage.

12. The combination of claim 11 wherein the first controller further includes a computer adapted to employ the received process instructions to effect control of the dispensing assembly.

13. The beverage system of claim 1 wherein the indicium is one of a readable code displayed on an outside surface of the beverage container and an RFID chip.

14. A beverage system comprising:

a beverage container having a beverage material therein and an indicium specific thereto; and a beverage appliance configured to receive the beverage container and a plurality of precursor supplies to enable the containment of a variety of precursor liquids each intended to interact with the beverage material to create a selected one of a variety of beverages, and a dispensing assembly, and a controller; wherein the beverage appliance includes an indicium reader and a first Bluetooth® transmitter/receiver, and is configured to combine the beverage material with liquid from a selected one of the precursor supplies within the beverage container; and a smartphone including a mobile app and a second Bluetooth® transmitter/receiver adapted for wireless communication with the first Bluetooth® transmitter/receiver;

wherein scanning the indicium and transmittal of information specific thereto to the smartphone by the beverage appliance causes the smartphone to prompt wireless interaction between a user and the beverage appliance to cause the user to select a desired beverage, and such selection causes the beverage appliance to extract a selected liquid from a selected one of the precursor supplies, to cause mixing of that selected liquid with the beverages material to create the desired beverage, and to cause the dispensing of the desired beverage.

15. The beverage system of claim 14 wherein the mobile app enables user interaction to prompt user-selectable additional process instructions specific to user preferences.

16. The beverage system of claim 14 wherein the indicium is one of a readable code displayed on an outside surface of the beverage container and an RFID chip.

17. The beverage system of claim 16 wherein the plurality of precursor supplies includes carbonated and non-carbonated water reservoirs.

18. The beverage system of claim 17 in combination with a user container removably supportable by the beverage appliance and adapted to receive the dispensed beverage.

19. The combination of claim 18 wherein the controller further includes a computer adapted to employ the received process instructions to effect control of the dispensing assembly.

* * * * *